US005520710A

United States Patent [19]

Olah

[11] Patent Number: 5,520,710

[45] Date of Patent: May 28, 1996

[54] CLEANER BURNING AND CETANE ENHANCING DIESEL FUEL SUPPLEMENTS

[75] Inventor: George A. Olah, 2252 Gloaming Way, Beverly Hills, Calif. 90210

[73] Assignee: George A. Olah, Beverly Hills, Calif.

[21] Appl. No.: 440,739

[22] Filed: May 15, 1995

Related U.S. Application Data

[63] Continuation-in-part of Ser. No. 214,346, Mar. 16, 1994, abandoned, and a continuation-in-part of Ser. No. 129,235, Sep. 29, 1993, abandoned.

[51] Int. Cl.[6] ..... C10L 1/18

[52] U.S. Cl. ..... 44/447; 44/448

[58] Field of Search ..... 44/447, 448

[56] References Cited

U.S. PATENT DOCUMENTS

| | | | |
|---|---|---|---|
| 2,218,135 | 10/1940 | Moser | 44/9 |
| 2,221,839 | 11/1940 | Lipkin | 44/9 |
| 2,240,145 | 4/1941 | Moser | 44/9 |
| 3,594,140 | 7/1971 | Badin | 44/76 |
| 4,738,686 | 4/1988 | Dillon et al. | 44/57 |

*Primary Examiner*—Jacqueline V. Howard
*Attorney, Agent, or Firm*—Pennie & Edmonds

[57] ABSTRACT

Symmetrical or unsymmetrical dialkyl and dicycloalkyl ethers, or alkyl-cycloalkyl (polycycloalkyl) ethers containing a total of 2 to 24 carbon atoms in which the oxygen atom is attached to primary or secondary, but not to tertiary carbon atoms are cleaner burning and cetane enhancing supplements for diesel fuels. The ether supplements are added in an amount of about 0.5 to 5% v/v. Cetane numbers can be further enhanced by adding 0.05 to 0.5% by weight of an alkyl or dialkyl peroxide compound having one to 12 carbon atoms in the alkyl group.

20 Claims, No Drawings

CLEANER BURNING AND CETANE ENHANCING DIESEL FUEL SUPPLEMENTS

CROSS-REFERENCE TO RELATED APPLICATIONS (U.S. National Phase Application Only)

This application is a continuation-in-part of application Ser. No. 08/214,346 filed Mar. 16, 1994 and a continuation-in-part of application Ser. No. 08/129,235 filed Sep. 29, 1993, both now abandoned.

TECHNICAL FIELD

This invention relates to the use of certain symmetrical or unsymmetrical dialkyl ethers, dicycloalkyl ethers, or alkyl-cycloalkyl ethers containing a total of 2 to 24 carbon atoms, in combination with alkyl or dialkyl peroxides having one to 12 carbon atoms in each alkyl group, as supplements to diesel fuels to provide a cleaner burning fuel with significantly decreased hydrocarbon, carbon monoxide and particulate matter emissions. These supplements also significantly enhance the cetane number of the fuel and impart other desirable properties to the fuel, such as lowered pour and cloud points.

BACKGROUND ART

Diesel fuel ranks second only to gasoline as a fuel for internal combustion engines. Trucks, buses, tractors, locomotives, ships, power generators, etc. are examples of devices that use diesel fuel. Passenger cars are another area of potential growth for the use of diesel engines that can provide improved fuel efficiency.

Unlike gasoline engines which operate by spark ignition, diesel engines employ compression ignition. In order to avoid long ignition delays resulting in rough engine operation, as well as to minimize misfiring and uneven or incomplete combustion which results in smoke in the exhaust gases that causes a major environmental problem, it is highly desirable to improve the burning quality of diesel fuels to minimize environmental pollutants such as hydrocarbons, carbo monoxide, particulate matters, etc. The cetane number (CN) is used to rate the ignition properties of diesel fuels. In general the cetane number depends primarily on its hydrocarbon composition. Saturated hydrocarbons, particularly those with straight, open chains, have relatively high cetane numbers, whereas unsaturated hydrocarbons have relatively low cetane numbers.

It is necessary to recognize that the relationship between the CN of diesel fuel and its performance cannot be equated in any way to the octane number of a gasoline and its performance in a spark-ignition engine. Raising the octane number allows an increase in the compression ratio and thus provides increased power and fuel economy at a particular fuel load. In contrast, in diesel engines, the desired CN provides good ignition at high loads and low atmospheric temperature. High cetane fuels eliminate engine roughness and diesel knock, allow engines to be started at lower temperatures, provide faster engine warm-up without misfiring or producing smoke and reduce formation of harmful deposits. On the other hand, too high cetane fuels can result in incomplete combustion and exhaust smoke due to too brief of an ignition delay which does not allow proper mixing of the fuel and air.

Commercial diesel fuels have CN numbers of at least 40. The suitable diesel fuel has appropriate volatility, pour and cloud point, viscosity, gravity, flash point and contain only small but tolerable levels of sulfur. It is also significant that carbon, residue formation and ash content should be kept low.

To enhance the properties of diesel fuels, particularly during ignition, cetane improvers are usually added. These compounds are typically aliphatic nitrates, such as isooctylnitrate. The stability, corrosiveness and toxicity of these or other multi-purpose additives are major issues. During winter in cold areas, ethanol is sometime added to diesel fuels to prevent fuel line and filter freezing. However, ethanol lowers the flash point of the fuel and increases corrosion problems.

It is known from U.S. Pat. No. 2,221,839 that straight chain aliphatic ethers such as n-butyl ether, n-amyl ether, mono-butyl ether of diethylene glycol, etc., can be used as ignition accelerators for hydrocarbon fuels of the compression ignition type. Generally, these ethers are added in an amount of as high as 50 or even 100% of the amount of the fuel. If desired, these ethers can be used by themselves as the fuel, although they are relatively more expensive.

In recent years, environmental concerns necessitate cleaner burning fuels with decreased detrimental emissions. Diesel fuels are no exception and there is need to diminish hydrocarbon, carbon monoxide, particulate matter, etc. emissions. Gasoline has been formulated with additives to help with this problem, but nothing useful has yet been developed for diesel fuel. Despite the need for similar additives for diesel fuel, no truly efficient diesel fuel improvers or enhancers have been discovered so far (See Gasoline and Motor Fuel, Kirk-Othmer Encyclopedia of Chemical Technology, 3rd ed., Wiley-Interscience, New York, Vol. 11, p.682–689, 1980).

SUMMARY OF THE INVENTION

The invention relates to a diesel fuel which contains a supplement for imparting cleaner burning characteristics to the fuel and also for enhancing the cetane number. This supplement comprises a dialkyl, dicycloalkyl or alkyl-cycloalkyl ether compound and an alkyl or dialkyl peroxide compound. The supplement is advantageously present in an amount sufficient to increase the cetane number of the diesel fuel by at least about 2 to 20 points.

Useful ethers contain 2 to 24 carbon atoms and may be symmetrical or unsymmetrical. Also, the oxygen atom is preferably attached to a primary or secondary carbon atom. Representative examples of preferred ethers include dihexyl ether, dioctyl ether, di(2-ethyl-1-hexyl) ether, ethyl hexyl ether, methyl octyl ether, ethyl octyl ether and methyl dodecyl ether. The ether compound is present in an amount of about 0.5–10% v/v, and preferably about 1–5% v/v.

The alkyl or dialkyl peroxide compound is present in an amount sufficient to further enhance the cetane number and burning properties of the diesel fuel. The alkyl or dialkyl peroxide compound would generally be in present in an amount of between about 0.05 to 0.5% v/v, preferably in a ratio of between about 1/10 and 1/100 the amount of the ether compound. Advantageously, a dialkyl peroxide which has the same alkyl groups as the ether compound can be used.

Another embodiment of the invention relates to a method for improving the burning efficiency of a diesel fuel which comprises adding to the fuel an ether compound and a peroxide compound in an amount sufficient to raise the cetane number and impart clean burning characteristics. Any of the ether compounds described above can be used in this method.

Although an oxygen containing gas such as air can be passed through or added to the fuel in an amount sufficient to promote the formation of peroxides therein, one of the alkyl or dialkyl peroxide compounds described above can conveniently be added to the fuel as a component of the supplement in an amount sufficient to further enhance the cetane number and burning properties of the fuel.

DETAILED DESCRIPTION OF THE INVENTION

I have now discovered a class of cleaner burning and cetane enhancing diesel fuel supplements. These additives are symmetrical or unsymmetrical dialkyl, dicycloalkyl, or alkyl-cycloalkyl ethers which contain a total of 2 to 24 carbon atoms, with the ether oxygen atom being attached to primary or secondary but not to tertiary carbon atoms. These ether compositions are thus fundamentally different from the octane enhancing tertiary alkyl ethers such as MTBE. Although the carbon atoms of each alkyl group can be between 1 and 12, the higher alkyl ethers, i.e., those having 4 or more carbon atoms in each alkyl group, are preferred.

Effective diesel improving higher alkyl ethers include dibutyl ether, dipentyl ether, dihexyl ether, diheptyl ether, dioctyl ether, dinonyl ether, didecyl ether, methyl hexyl ether, ethyl hexyl ether, methyl heptyl ether, ethyl heptyl ether, methyl octyl ether, ethyl octyl ether, methyl decyl ether, ethyl decyl ether, methyl dodecyl ether, ethyl dodecyl ether, hexyl heptyl ether, hexyl octyl ether, hexyl nobornyl ether, hexyl decyl ether, heptyl pentyl ether, heptyl decyl ether, octyl butyl ether, octyl pentyl ether, octyl hexyl ether, octyl heptyl ether, nonyl propyl ether, nonyl octyl ether, nonyl decyl ether, decyl ethyl ether, decyl propyl ether, decyl butyl ether, decyl pentyl ether, decyl hexyl ether, decyl heptyl ether, decyl octyl ether, di(cyclopentylmethyl) ether, di(cyclopentyl-β-ethyl) ether, di(cyclohexyl-methyl) ether, di(cyclohexyl-β-ethyl) ether and the like.

Also effective are alkyl-cycloalkyl, dicycloalkyl, alkyl bi(tri, tetra)cycloalkyl and dibicycloalkyl ethers, such as hexyl cyclohexyl ether, hexyl cycloheptyl ether, hexyl cyclooctyl ether, dicyclohexyl ether, heptyl cyclopentyl ether, heptyl cyclohexyl ether, heptyl cycloheptyl ether, heptyl cyclooctyl ether, di-cycloheptyl ether, octyl cyclopentyl ether, octyl cyclohexyl ether, octyl cycloheptyl ether, octyl cyclooctyl ether, dioctyl ether, di-2-norbornyl ether, di-adamantyl ether, diperhydrodicyclopentadienyl ether and the like.

Also effective are the alkyl di- or polycycloalkyl ethers, as are bis (di- and poly)cycloalkyl ethers. These examples are representative but in no way limiting of the types of alkyl(cycloalkyl) ethers which are effective as a component of the diesel fuel supplements disclosed herein.

As noted above, the ether compound is present to the composition in an amount of about 0.5 to 10% and preferably 1 to 5% v/v/ and results in decreased particulate matter emission when the fuel is combusted.

For the preparation of these ethers, the original Williamson method of ether synthesis using an alkoxide and an alkyl halide works well for acyclic unencumbered open chain primary halides (see March, J. "Advanced Organic Chemistry, Reactions, Mechanisms and Structures", 3d ed., Wiley-Interscience, New York, N.Y., 1985.

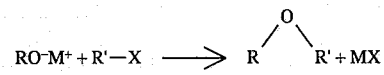

M = $Li^+$, $Na^+$, $K^+$

Dialkyl ethers are readily prepared by a variety of methods, including dehydration of the corresponding alcohols with acids, including solid acids such as NAFION®—H or sulfonated polystyrene resins.

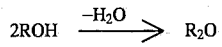

These methods are not applicable to cyclic and polycyclic systems. Bimolecular dehydration of alcohols gives the lower acyclic ethers, but generally results in complex product mixtures due to intramolecular dehydration products with higher homologs or cycloalkyl systems. In spite of many diverse approaches in the literature for the synthesis of specific ethers, no cogent general synthetic methods exist.

Olah et al. have developed a general methyl ether synthesis which employs reductive alkylation of carbonyl compounds (G. A. Olah et al., *J. Org. Chem* 1986, 51 2826). The reaction involves treatment of the carbonyl compound with trimethylorthoformate or other trialkylorthoformates catalyzed by superacidic perfluorinated resin sulfonic acids such as NAFION®—H, followed by reaction with triethylsilane. The general reaction is

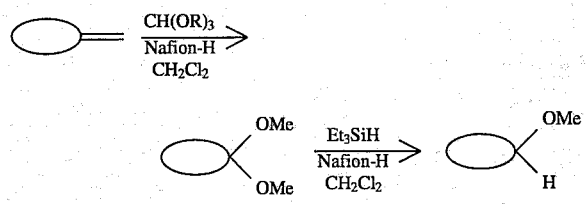

Using the above procedure polycycloalkyl methyl (alkyl) ethers are synthesized from the corresponding carbonyl compounds.

Alkyl-cycloalkyl ethers are also readily prepared by acid catalyzed methanolysis (alcoholysis) of easily available olefins, such as bicyclo[2.2.2]heptene (norbornene) or cyclopropane derivatives such as Binor-S (a 4+4 dimer of bicyclo [2.2.1]heptadiene (norbornadiene)) using for example the convenient solid superacid, Nafion®—H (G. A. Olah et al., *Synthesis,* 1986, 513). Many of these ethers are readily obtainable from refinery byproduct streams containing cyclopentadiene.

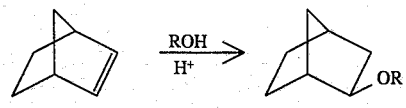

Sassaman et al. *J. Org. Chem.* 1987, 52, 4314; *Tetrahedron,* 1988, 44, 3771 have also developed a more general ether synthesis method by direct reductive coupling of carbonyl compounds. Carbonyl compounds are reductively coupled to symmetrical ethers in the presence of triethylsilane and a catalytic amount of trimethylsilyl triflate or trimethylsilyl iodide.

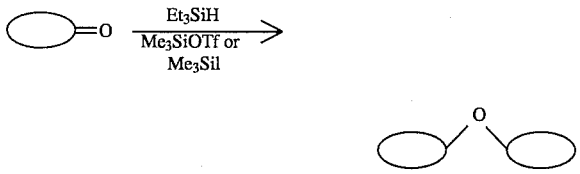

Using this general methodology symmetrical bicyclic and polycyclic ethers can be synthesized.

Unsymmetrical ethers can also be prepared by adopting the reductive condensation of carbonyl compounds with alkoxysilanes

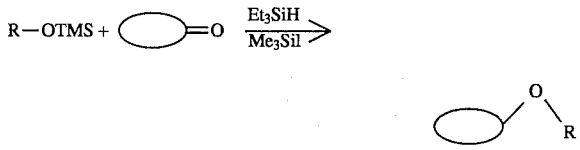

Representative unsymmetrical ethers suitable as diesel improvers include the following:

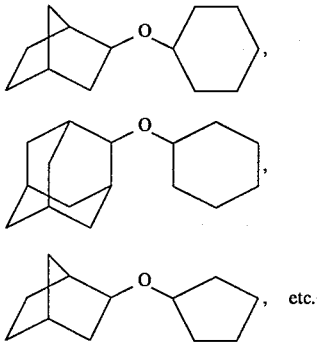

etc.

It is part of my invention that ether oxygenates enhance cleaner burning properties and elevate cetane number by their ability to initiate radical processes essential for efficient combustion. This is affected in part by their ability to form peroxides which then act as radical sources. This effect can be enhanced by storing the diesel fuel ether supplement blends in contact with oxygen or air or by passing oxygen or air through them.

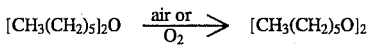

To uniformly and in a controlled way improve CNs, particularly when using smaller amounts of the ether compounds, 0.05 to 0.5% by weight of an alkyl or dialkyl peroxide compounds are added as part of the supplement. As noted above, these peroxide compounds are added in a ratio of between about 1/10 and 1/100 of the amount of the ether compounds. These peroxide compounds preferably have alkyl substituents of between one and 20 carbon atoms which are straight chain or branched. For the dialkyl compounds, the alkyl substituents can be the same or different and can be symmetric or asymmeric. Preferably, the symmetric dialkyl peroxide compounds are preferred. The dialkyl peroxide compounds which have the same or similar alkyl groups as the ether compound are advantageously used, because they are highly compatible with the ether compounds. The dialkyl peroxides, and in particular butyl, pentyl, hexyl, or octyl peroxides, are stable by themselves as well as in the presence of the ether compounds. The combination results in the formation of only a very limited amount of insoluble gum to thus provide convenient stable diesel fuel supplements.

The new ether-peroxide diesel supplements are able to significantly improve the performance of diesel fuels. Environmental cleanness is enhanced by cleaner burning and decreased generation of pollutants, i.e., smoke, particulate, incomplete burning products. At the same time, these supplements are also very efficient cetane enhancers, thus eliminating the need for toxic additives such as octyl nitrate.

EXAMPLE

To show that the aforementioned ether-peroxide supplements provide significantly improved and cleaner burning characteristics, an emission screening test was performed according to the ERA Federal Test Procedure specified in CFR 40, Part 86, subpart N on a prototype 1991 Detroit Diesel Corporation (DDC) Series 60 heavy duty diesel engine with a typical Diesel No. 2 Fuel to which 5% (v/v) of an ether compound was added. Results are shown below in the table.

| Fuel | Cetane No. |
|---|---|
| A: Neat Diesel fuel No. 2 | 42.8 |
| A + 2% (wt) dihexyl ether | 44.8 |
| A + 5% (wt) dihexyl ether | 46.3 |
| A + 2% (wt) dioctyl ether | 47.8 |
| A + 5% (wt) dioctyl ether | 49.1 |
| A + 5% dihexyl ether + 0.5% t-butyl peroxide | 59.6 |

Dihexyl ether is a highly useful ether component. Its boiling point is 228°–229° C., which makes it compatible for blending into diesel fuels. The addition of 2% dihexyl ether alone increases the CN of the fuel by 2 points, whereas the addition of 5% increases the CN by 3.5 points.

Dioctyl ether is an even better supplement: its boiling point is 286°–287° C. When blended into No. 2 diesel fuel (CN 42.8), the measured engine CN increases according to the amount blended to above 49 when 5% is used, an increase of over 6 points.

The CN number is further increased in an unexpected manner by the addition of an alkyl or dialkyl peroxide compound. As shown in the table, the addition of 0.5% of butyl peroxide to 5% dioctyl ether increases the CN of the fuel to about 60 while maintaining good stability and flash point.

Moreover, the hydrocarbon, carbon monoxide and soluble oil fraction of particulate matter emissions for the last sample was reduced by 32, 14 and 38 per cent, respectively. As little as 0.2% of the alkyl or dialkyl peroxide compound provides an increase in cetane number without forming any appreciable amount of insoluble gum in the fuel, thus reducing particulate emissions.

What is claimed is:

1. A clean burning diesel fuel composition comprising diesel fuel and a diesel fuel supplement comprising a dialkyl, alkyl-cycloalkyl or dicycloalkyl ether compound that contains a total of 2 to 24 carbon atoms and an alkyl or dialkyl peroxide that contains 1 to 12 carbon atoms in each alkyl group, said supplement being present in an amount sufficient to raise the cetane number and impart clean burning characteristics to the diesel fuel by reducing the amount of emission hydrocarbons.

2. The composition of claim 1 wherein the ether compound is symmetrical and the oxygen atom is attached to a primary or secondary carbon atom.

3. The composition of claim 1 wherein the ether compound is dibutyl ether, dihexyl ether, dioctyl ether, di(2 ethyl 1-hexyl) ether, or methyl dodecyl ether.

4. The composition of claim 1 wherein the ether compound is an alkyl bi(tri, tetra)cycloalkyl, dibicycloalkyl, alkyl polycyclo, or bis (di- and poly) cycloalkyl ether compound.

5. The composition of claim 1 wherein the ether compound is present in the composition in an amount of about 0.5 to 5% v/v.

6. The composition of claim 1 wherein the ether compound is present in an amount sufficient to increase the cetane number of the diesel fuel by at least about 2 points.

7. The composition of claim 1 wherein the peroxide compound is present in an amount of between about 0.05 and 0.5% v/v.

8. The composition of claim 1 wherein the peroxide compound is present in an amount of between about 1/10 and 1/100 the amount of the ether compound.

9. The composition of claim 1 wherein the peroxide compound is a dialkyl peroxide wherein each alkyl group has at least four carbon atoms.

10. The composition of claim 1 wherein the peroxide compound is dibutyl, dipentyl, dihexyl, or dioctyl peroxide.

11. A method for improving the burning efficiency of a diesel fuel which comprises adding to the fuel a supplement comprising a dialkyl, alkyl-cycloalkyl or dicycloalkyl ether compound that contains a total of 2 to 24 carbons atoms in an amount sufficient to raise the cetane number and an oxygen containing compound in order to impart clean burning characteristics to the fuel by reducing the amount of emission hydrocarbons when the fuel is burned.

12. The method of claim 11 which further comprises selecting the ether compound to be a symmetrical or unsymmetrical dialkyl, alkylcycloalkyl or dicycloalkyl ether compound.

13. The method of claim 11 which further comprises selecting the ether compound to have the oxygen atom attached to a primary or secondary carbon atom.

14. The method of claim 11 which further comprises selecting dihexyl ether, dioctyl ether, di (2-ethyl 1-hexyl) ether, or methyl dodecyl ether as the supplement.

15. The method of claim 11 which further comprises adding the ether compound in an amount sufficient to increase the cetane number of the fuel by at least 2 to 20 points.

16. The method of claim 11 which further comprises adding the ether compound to the fuel in an amount of about 0.5 to 10% v/v.

17. The method of claim 11 wherein the oxygen containing compound comprises air or oxygen gas and which further comprises passing the air or oxygen gas through the fuel in an amount sufficient to promote the formation of alkyl or dialkyl peroxides therein.

18. The method of claim 11 wherein the oxygen containing compound is an alkyl or dialkyl peroxide compound that contains 1 to 12 carbon atoms in each alkyl group and which is added with the supplement in an amount sufficient to further enhance the cetane number and burning properties of the fuel.

19. The method of claim 18 wherein the alkyl peroxide or dialkyl compound is a dialkyl peroxide wherein each alkyl group has at least four carbon atoms and which is added in an amount of between 0.05 to 0.5%.

20. The method of claim 19 wherein the ether compound is added to the fuel in an amount of about 0.5% to 5% v/v and the alkyl or dialkyl peroxide compound is added in an amount of between about 1/10 and 1/100 the amount of the ether compound.

* * * * *